US009347753B1

(12) United States Patent
Horch et al.

(10) Patent No.: US 9,347,753 B1
(45) Date of Patent: May 24, 2016

(54) NON-PYROTECHNIC, LOW OBSERVABLE TRACER

(71) Applicants: Matthew T. Horch, Hillsborough, NJ (US); Christel M. Kelly, New Providence, NJ (US); Garry P. Glaspell, Mechanisville, VA (US)

(72) Inventors: Matthew T. Horch, Hillsborough, NJ (US); Christel M. Kelly, New Providence, NJ (US); Garry P. Glaspell, Mechanisville, VA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 55 days.

(21) Appl. No.: 14/309,063

(22) Filed: Jun. 19, 2014

(51) Int. Cl.
*F42B 33/02* (2006.01)
*F42B 12/38* (2006.01)

(52) U.S. Cl.
CPC ..... *F42B 33/02* (2013.01); *F42B 12/387* (2013.01); *F42B 12/38* (2013.01)

(58) Field of Classification Search
CPC ..... F42B 12/38; F42B 12/387; F42B 12/40; F42B 12/42; F42B 12/44
USPC ..... 102/513, 458, 459, 364, 365, 501; 86/23, 54
See application file for complete search history.

(56) References Cited

U.S. PATENT DOCUMENTS 3,757,632 A * 9/1973 Bellinger ..... F42B 12/387 102/336
4,015,258 A * 3/1977 Smith ..... F41G 3/06 342/119
8,402,896 B1 * 3/2013 Hollerman ..... F42B 12/38 102/458

* cited by examiner

*Primary Examiner* — Samir Abdosh
*Assistant Examiner* — John D Cooper
(74) *Attorney, Agent, or Firm* — Henry S. Goldfine

(57) ABSTRACT

A method of manufacturing a low observable photoluminescent tracer projectile, for use with a small caliber weapon at night—which method utilizes a base phosphor material of Ca, Sr and S, or a base phosphor material of $Y_2$, $O_2$, and S—with a combination of minor dopant ingredients; which base phosphor material is mixed with a clear binder to form a photoluminescent material which is applied to the rear end, or base, of a small arms projectile as a thin layer; to which thin layer is added a layer of small retro-reflectors—whereby, when this projectile is fired from the weapon, the photoluminescent mixture will be activated and will be observable, using night vision at an angle of 0 to about 20 degrees from the rear end of the projectile.

10 Claims, 3 Drawing Sheets

NON-PYROTECHNIC, LOW OBSERVABLE TRACER

FEDERAL RESEARCH STATEMENT

The inventions described herein may be manufactured, used and licensed by, or for the U.S. Government, for U.S. Government purposes.

BACKGROUND OF INVENTION

1. Field of the Invention

The present invention relates to luminescent material for use as military tracer rounds and more particularly, to such materials whose photoluminescence is excited by the energy emitted by military propellants and are thereby observable at night, with the aid of conventional night vision devices.

2. Related Art

Historically, gunners relied on observing the impact of their bullets (i.e. projectiles) in order to adjust their aim—which is not effective, as often the impact point is not visible. As a solution to this problem, in about 1915 tracer ammunition (also referred to as pyrotechnic tracer, standard tracer, standard pyrotechnic tracer, and/or M62 Tracer) was introduced—ammunition containing a pyrotechnic composition that burned very brightly—making the projectile visible to the naked eye. A disadvantage of such brightly burning pyrotechnic is that the enemy can easily trace back the stream of tracer ammunition to disclose the gunner's position. To help remediate this problem, subdued tracers have a built in delay—which causes them to burn brightly after at least 100 yards—such that it isn't easy to establish the position of the gunner. But, such a delay is only partially effective—so, dim tracers were introduced, wherein the tracer can only be viewed with the aid of night vision equipment—allowing the gunner to better observe his fire and "walk" it to the desired location in low light or night conditions.

Most modern military forces use projectiles containing energetic tracer materials based on technology developed in the early 1900s. Such tracer materials are generally pyrotechnic compositions, which are composed of mixtures of a fuel reactant and an oxidizer reactant—such that no external sourced oxygen is required to sustain the reaction. The subject incendiary reaction generates light through a self-sustaining, non-detonative, exothermic chemical reaction, similar to that used in a road flare. Despite various technological advancements that have been made in the years since such pyrotechnic tracers were introduced, such pyrotechnic energetic type tracers still have significant shortcomings. These shortcomings include—(1) the exothermic incendiary nature of energetic tracer materials makes them a fire hazard—especially in wooded or grass covered training areas—and can present significant undesirable consequence in battle; (2) the tracers lose mass in flight as the pyrotechnic reaction progresses, creating an inherent inaccuracy and lack of precision; (3) the particular pyrotechnic materials used for energetic tracers create environmental and hazardous material problems; (4) the energetic tracer, using incendiary fuels and oxidizers are difficult to manufacture; and, finally, (5) pyrotechnic energetic tracers are bi-directional, i.e. meaning they can be seen by the shooter as well as the enemy.

Conventional, standard energetic tracer projectiles typically hold the pyrotechnic material in a hollow or cavity located within their base or rear section, as shown in FIG. 1. Conventional dim tracers are similar in design to such standard pyrotechnic daylight/night tracers; except, for a different pyrotechnic mix. In either case, the pyrotechnic material is ignited by the burning of the energetic propellant within the cartridge that houses the projectile and the pyrotechnic burns brightly during its flight to target.

The usual practice is to load cartridges containing energetic tracers, i.e. tracer rounds or bullets, into an ammunition belt at a ratio of one tracer bullet per every four non-tracer rounds, in ground-based guns, and one tracer per every four or nine non-tracer rounds in aircraft mounted guns. Unfortunately, energetic tracers can never be a totally reliable indicator of a gunner's aim, because the energetic tracer projectiles have different aerodynamic properties and weights when compared to standard rounds/projectiles that are being fired with the energetic tracer. This difference is primarily due to the fact that the mass of the energetic tracer changes as the pyrotechnic material burns, and is ejected out of the cavity in the back of the projectile during flight (pyrotechnic tracers typically leave behind a narrow cloud of burning material that can be up to about a meter long), versus the unchanging mass of a non-tracer projectile. By design, tracer and non-tracer rounds match their relative trajectories at about 600 yards.

Because the material used to manufacture energetic tracers is pyrotechnic, energetic tracer ammunition must be produced in a production line separate from any standard ammunition production line, due to safety concerns. Further, in order to accommodate the tracer material, the length of an energetic tracer bullet is typically longer than a standard bullet of the same caliber. The increased length also adds to the complexity of manufacture because the tracer bullet takes up additional space in the cartridge that would otherwise be used for the propellant in a non-tracer round.

There have been attempts to produce tracers without the shortcomings mentioned above. For example, U.S. Patent Application Publication No. 2004/0099173 teaches the use of a light emitting diode (LED) and capacitor, in-place of a pyrotechnic material, in an attempt to decrease tracer visibility. Likewise, U.S. Patent Application Publication No. 2005/0034627 teaches the use of an electronic light source in lieu of the use of a pyrotechnic material. However, such attempts still result in a tracer bullet with a mass substantially different than the normal bullet.

Furthermore, U.S. Pat. Nos. 6,497,181 and 6,990,905 teach the use of materials in tracer ammunition whereby two chemicals are mixed together to provide a chemical reaction subsequent to firing or launching of the bullet, thereby creating visible light. This is known as a chemiluminescent material. This type of tracer ammunition provides a trace of the path of the projectile and also serves as a marker; whereby, the projectile breaks apart upon impact, scattering the chemiluminescent material. However, the use of chemiluminescent materials in tracer ammunition requires a chemical reaction, wherein at least two chemiluminescent materials need to react to form at least one new compound. Such tracer rounds require an added manufacturing expense because of the need to separate the individual chemicals prior to firing. This separation of chemicals may also take up space in the bullet, making it either less massive, or making the bullet longer to provide for the chemical chambers. Further, the separation of chemicals will also make the bullet more prone to damage during handling. In addition, after firing, the two chemicals must adequately mix in order to result in the desired luminescence. Also suitable environmental conditions may be needed to allow the chemical reaction to occur. Furthermore, the chemiluminescent tracers can only be seen in flight by way of a transparent window in the bullet, which has practical constraints due to the material limitations and installation of the window.

Another alternative tracer is disclosed in U.S. Pat. No. 8,402,896, which details photoluminescent tracer materials. Unfortunately, the particular photoluminescent materials disclosed have been proven to be ineffective, as not bright enough for use with the currently available night vision equipment at the required minimum distance of about 400 meters.

Consequently, there is a need for new low light or night condition tracer projectiles, usable with night vision equipment, capable of overcoming the shortcomings of the current alternatives as detailed above.

SUMMARY OF INVENTION

The present invention addresses the above detailed problems and failings in the prior art, by providing a method for manufacturing an enhanced, functional, low observable photoluminescent tracer round/projectile, useful for small arms, i.e. small caliber applications including pistols, rifles, and machine guns—wherein the tracer is visible only at an angle of from 0 to about 20 degrees from the rear of the projectile, under low light or night conditions using a night vision device, at a distance of at least 400 meters. The subject low observable tracer projectile is formed of a combination of a sprinkling, i.e. a plurality of small retro-reflective glass beads, or cat's eye retro-reflectors, or corner cube retro-reflectors, coated on the surface of novel photoluminescent tracer material, which material can be either (1) a first phosphor base material of about 0 to about 50 wt. % Ca, about 0 to about 50 wt. % Sr, and about at least 50 wt. % S, with a combination of minor dopant ingredients selected from the group of Eu, Sm, Dy, Ce, Mn, Cu, Al, and Tm (hereinafter the Ca/Sr/S embodiment); or (2) a second base phosphor material of about 20 to about 49 wt. % $Y_2$, about 25 wt. % $O_2$, and about 25 wt. % S, with a combination of minor dopant ingredients selected from the group of Yb, Er, Ho and Tm (hereinafter the $Y_2/O_2/S$ embodiment). Each of these alternative embodiment phosphor base materials is compounded with at least about 40 to about 70 weight percent, more preferably about 50%, of a clear binder, preferably Hardman® Double-Bubble Water-Clear Epoxy (also known as Hardman® Green epoxy or binder—which is a commercial 2-part epoxy). The resulting phosphor base/epoxy composition is adhered as a coating on the flat rear surface of standard military small arms rounds (including pistol, rifle, and machine gun projectiles); withstands the forces of that projectile being fired; and absorbs sufficient energy from the propellant during such firing—so as to reemit that energy at an intensity and for a sufficient period of time so as to be observed by current night vision devices for a distance of the at least 400 meters.

As stated above, the self-adhering materials of the present invention located on the flat rear end of military projectiles, provide a very low observable tracer—i.e. a tracer which is only observable by an observer located at 0 to about 20 degrees from the center of the rear end of the projectile. In other words, to observe the subject inventive tracer (with the requisite night vision device), one must be located toward the rear end of the projectile, within an angle of about 20 degrees or less from the centerline of the projectile extended from the rear thereof (equal to about 40 degrees in arc).

The subject inventive alternative photoluminescent tracer materials are excitable by military propellants—which primarily emit energy in a range of from about 600 to 1,500/2,000 nm—and, wherein the Ca/Sr/S embodiment is excited at a wavelength of about 500-590 nm and re-emits at from about 600 to about 750 nm—at an intensity of about 27 μwatts. The $Y_2/O_2/S$ embodiment is excited at a wavelength of about 980 nm and re-emits is a bimodal emission—with a first peak at about 550 and a second and stronger peak at about 675 nm—at an intensity of about 8.4 μwatts. Importantly, considering that the typical human eye responds to wavelengths from about 390 to 700 nm—both the Ca/Sr/S and $Y_2/O_2/S$ alternative photoluminescent tracer materials re-emit within wavelengths that can be seen—however, interestingly, while the intensity of the $Y_2/O_2/S$ embodiment is less than the Ca/Sr/S embodiment, it's re-emit wavelengths are more observable by providing greater emissions closer to the center of the eye's vision range. Further, the brightness of both alternative embodiments are significantly enhanced with the addition of the retro-reflectors—where the brightness measured at 12 inches is 1.5 times greater than without the retro-reflectors (as detailed below).

In addition to the intensity, i.e. brightness, and observability to the human eye, of the subject inventive photoluminescent tracer materials, it is critical that these photoluminescent materials exhibit a "luminescence time", i.e. the time interval over which the photoluminescent material radiates an observable luminescence. It is critical that the luminescence time be such that the projectile can be traced to reach a target of at least 400 meters—which is the case with both the $Y_2/O_2/S$ and the Ca/Sr/S embodiments. More preferably, the luminescence time should that a round traveling at least 500 meters, and up to about 600 meters can be observed—which is the case with the Ca/Sr/S embodiment. Therefore, while the brightness/intensity of the Ca/Sr/S embodiment is not as great as the alternative $Y_2/O_2/S$ embodiment—the Ca/Sr/S embodiment is preferred, as it has a significantly greater luminescence time, per quantity applied to the projectile, than the $Y_2/O_2/S$ embodiment.

As detailed above, in the present invention, preferably a quantity of small retro-reflective glass beads, cat's eye, or corner cubes are sprinkled or coated about the surface of the photoluminescent tracer material. More preferably, such small retro-reflectors are inexpensive sand like glass beads used on streets and traffic signs—that meet Federal and state standards for such uses. Such retro-reflective beads are available commercially from Cole Safety Products, in Ashland, Ky., at a size of from about 45 to about 850 microns, with a roundness of >=70% and a refractive index of >=1.51.

Further features and advantages of the present invention will be set forth in, or apparent from, the drawings and detailed description of preferred embodiments thereof which follows.

BRIEF DESCRIPTION OF THE DRAWINGS

A more complete understanding of the present invention disclosure may be realized by reference to the accompanying drawings in which.

DETAILED DESCRIPTION

As detailed above, the present invention provides a functional, low observable photoluminescent tracer round/projectile, visible only at an angle of 0 to about 20 degrees from the rear end of the projectile, which can be seen at night, with the aid of a night vision device, to a distance of at least 400 meters. The subject low observable tracer projectile is formed of a combination of a sprinkling, i.e. a plurality of small retro-reflective glass beads, or cats eye retro-reflectors, or corner cube retro-reflectors, coated on the surface of novel photoluminescent tracer material, which material can be either (1) a first phosphor base material of about 0 to about 50 wt. % Ca, about 0 to about 50 wt. % Sr, and about at least 50 wt. % S, preferably about 0 to about 50 wt. % Ca and about at least 50 wt. % S; with a combination of minor dopant ingredients selected from the group of Eu, Sm, Dy, Ce, Mn, Cu, Al, and Tm; or (2) a second base phosphor material of about 20 to about 49 wt. % $Y_2$, about 25 wt. % $O_2$, and about 25 wt. % S, with a combination of minor dopant ingredients selected from the group of Yb, Er, Ho and Tm. Each of these alternative embodiment phosphor base materials is compounded with at least about 40 to about 70 weight percent, more preferably about 50%, of a clear binder, preferably Hardman® Double-Bubble Water-Clear Epoxy (also known as Hardman® Green epoxy or binder—which is a commercial 2-part epoxy). The resulting phosphor base/epoxy composition self-adheres as a coating on the flat rear surface of standard military small arms rounds (including pistol, rifle, and machine gun projectiles); withstands the forces of that projectile being fired; and absorbs sufficient energy from the propellant during such firing—so as to re-emit that energy at an intensity and for a sufficient period of time so as to be observed by current night vision devices for a distance of at least 400 meters.

Figure 1:
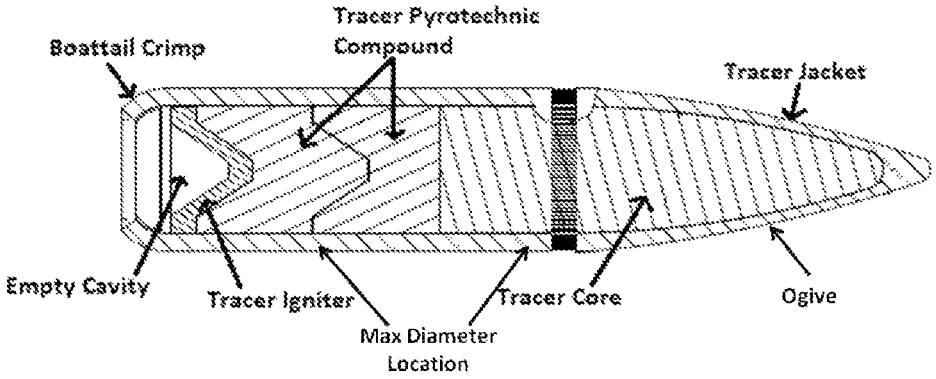
Fig. 1 Prior Art
FIG. 1 is a cross-section of a prior art pyrotechnic type tracer projectile.
Figure 2:
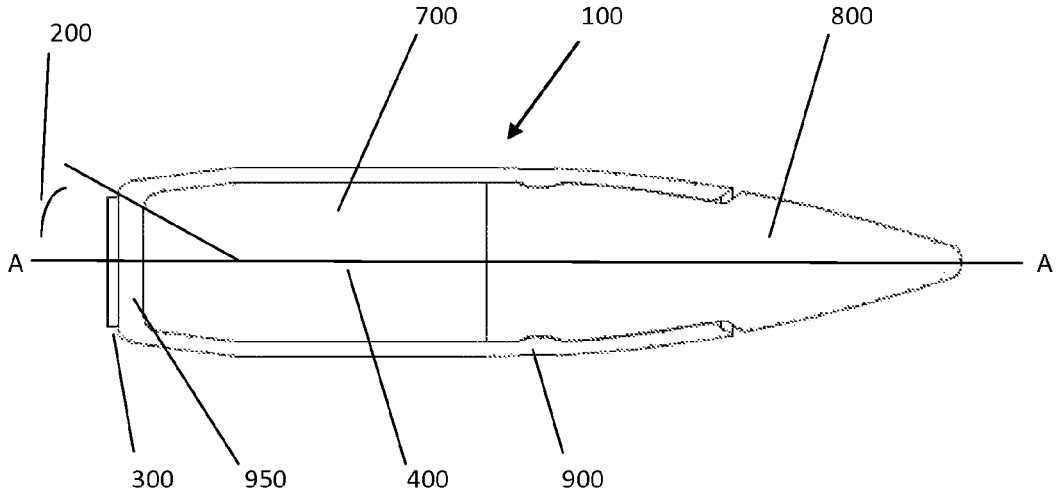
FIG. 2 is a cross-sectional view of an embodiment of the current invention, wherein there is a flat coating of the inventive phosphor photoluminescent tracer material located along the flat rear end of a typical projectile.

Referring to FIG. 2, a first embodiment of the present invention showing a photoluminescent tracer round/projectile, 100. As shown, the subject inventive projectile, 100, may typically be comprised of a penetrator tip, 800, of steel—located and forming the nose of the projectile; a slug central body of lead, 700; and a surrounding jacket, 900, of copper; wherein there is a thin layer (note: which can be dome shaped if desired) of the photoluminescent phosphor, 300, located along the exterior of the base, 950, of the projectile, 100. Also, as shown, the tracer material is observable at an angle, 200, of about 20 degrees from the centerline, A-A, of the projectile, 100, from the rear thereof; thereby providing the desired low observable photoluminescent tracer.

As stated above, at least about 40 to about 70 weight percent of a clear binder is required, preferably such as Hardman® Green epoxy, available from Royal Adhesives and Sealants, LLC, a division of Harcros Chemicals, Inc., located in Belleville, N.J. Use of less than 40% binder failed as the projectiles either did not trace at all, or, the thin layer of tracer material broke-up shortly after exiting the barrel. Further, other standard binder systems failed for various reasons—as detailed in Table 1, below:

TABLE 1

Failed alternative binder systems

| Material | Material Type | Reason Failed |
|---|---|---|
| Devcon 5 min | Epoxy-Binder | Too brittle - did not survive firing |
| LN-207 | Silicone-Binder | Can corrode copper jacket of projectile |
| Silicone Resin (840) | Silicone-Binder | Not clear - visible light could not pass through |
| Loctite 5083 (moisture secondary) | UV curable Silicone-Binder | Not clear - visible light could not pass through; also can corrode copper jacket of projectile under certain conditions |
| Loctite 7811 | Hot melt-Binder | Not clear - visible light could not pass through |

The preferred quantities of the required minor dopant ingredients are detailed in Table 2, below, please note that each weight percentage given is "about" the endpoint of the presented ranges shown, and that any amount within the given ranges is functional. Further, the particular rare earth and transition metal ingredients useful in the present invention, can be added to the subject formulation as chloride or oxide compositions—containing the particular rare earth or transition metals (e.g. for Eu use $EuCl_3$, for Sm use $SmCl_3$, for Cu use $CuCl_2$, or for Al use $AlCl_3$).

TABLE 2

Quantities of Minor Dopant Ingredients in Ca/Sr/S and $Y_2/O_2/S$ preferred embodiments - all percentages are "about" the end-points shown.

| Embodiment | Quantity of Dopant Ingredients (in Weight Percentage) |
|---|---|
| Ca/Sr/S | Eu (0.01-1%); Sm (0.01-1%); Dy (0-1%); Ce (0.01-1%); Mn (0-1%); Cu (0-1%); Al (0.01-1%); Tm (0.01-1%) |
| $Y_2/O_2/S$ | Yb (1-20%); Er (0-6%); Ho (0-6%); Tm (0.01-6%) |

Typical propellants useful in the present invention, i.e. propellants which primarily emit energy in a range of from about 600 to about 2,000 nm—and, energy which exits the Ca/Sr/S and $Y_2/O_2/S$ embodiments of the present invention—are listed in Table 3, below—along with the source for each.

TABLE 3

Typical military propellants useful in the present invention.

| Propellant | Source |
|---|---|
| SMP-842 | General Dynamics Ordnance & Tactical Systems, Crawforville, FL 32327 |
| WC-844 | General Dynamics Ordnance & Tactical Systems, Crawforville, FL 32327 |
| WC-846 | General Dynamics Ordnance & Tactical Systems, Crawforville, FL 32327 |
| WC-860 | General Dynamics Ordnance & Tactical Systems, Crawforville, FL 32327 |
| HPC-33 | ATK Ammunition and Powder Company, Radford, VA 24143 |
| WPR-289 | General Dynamics Ordnance & Tactical Systems, Crawforville, FL 32327 |

To aid in the understanding of the subject invention, the following examples and processes of manufacture/assembly are provided as illustrative thereof; however, they are merely examples and should not be construed as limitations on the claims:

EXAMPLES

As an example of a preferred embodiment of the present invention, the Ca/Sr/S phosphor material useful in the present invention can be prepared in a typical reaction, using chemicals which were reagent grade, purchased from Sigma-Aldrich Corporation, without any further purification; wherein for example: 10 g $CaCO_3$, 10 g S, 0.05 g KCl, and 0.05 g NaCl, are mixed with the corresponding amounts of the dopant ingredients—such as the rare earth chlorides ($EuCl_3$, $SmCl_3$, $DyCl_3CeCl_3$) and/or transition metal chlorides ($MnCl_2$, $CuCl_2$ and $AlCl_3$) and placed in a ball mill (Retsch, PM 100) at 300 RPM for four hours. The resulting mixture was then fired in a furnace (Thermo Scientific, ED 1545M) for two hours at 1200° C. in an oxygen free zone. To achieve an oxygen free environment the double crucible method is implemented. The inner crucible contains the mixture and the outer one is filled with graphite to scavenge oxygen.

As a second example of another preferred embodiment of the present invention, the $Y_2/O_2/S$ phosphor material useful in the present invention can be prepared in a typical chemical reaction, using chemicals which were reagent grade, purchased from Sigma-Aldrich Corporation, without any further purification; wherein for example: stoichiometric amounts of $Y_2O_3$, $Yb_2O_3$, $Er_2O_3$ were milled with a fluxing agent comprised of 50% $Na_2CO_3$, 80% S, 10% $Li_2CO_3$, and 20% $K_3PO_4$ (by weight) using a planetary ball mill (Retsch, PM 100). The precursor mixture was transferred to an alumina crucible and nested inside a larger crucible containing activated carbon. The precursor mixture was then heat treated in a furnace (Thermo Scientific, FD1545M) for 3 h at 1100° C. After cooling, the product was washed with dilute $HNO_3$ and water several times and dried overnight at 80° C. in a vacuum oven.

Further, the combined phosphor material and epoxy mixture useful in the present invention were prepared using hand mixing of the materials together in a bowl with a metal spatula for all rifle and pistol calibers. The particular steps for this mixing process and application of a thin flat layer or domed layer to the rear of the rifle or pistol projectiles involved the following steps:

Step 1: Clean the back of the projectiles with isopropyl alcohol and allow them to dry. Determine your batch size of phosphor and binder mixtures in the correct ratios taking into account that the combination of the 2-part epoxy must equal the remainder of the weight not utilized by the phosphor. Various 2-part epoxies require their monomer and catalyst to have different amounts, the preferred Hardman® Green (HG) is a 2:1 ratio of monomer to catalyst. An example of the results from a series of experiments of such mixing is given in Table 4, below.

TABLE 4

Phosphor/Binder Mixing Results**

| Mix Ratio | Desired Wt (HG Yellow)* | Actual Wt (HG Yellow) | Desired Wt (HG Clear)* | Actual Wt (HG Clear)* | Desired Wt (Phosphor) | Actual Wt (Phosphor) |
|---|---|---|---|---|---|---|
| 50%/50% | 0.083 g | 0.0824 g | 0.167 g | 0.1662 g | 0.2486 g | 0.2487 g |

*HG Yellow is the catalyst and HG Clear is the monomer

**The amounts shown of material adhered to multiple projectiles

Step 2: Weigh out the specific amounts of monomer, catalyst, and phosphor taking into account the correct ratios of monomer and catalyst as suggested by the manufacturer. All components should be put in separate containers so the monomer and catalyst will not mix unintentionally, which would prematurely begin the curing process (containers such as—plastic bowls, wax paper, etc).

Step 3: Using the container with the monomer and a metal spatula to mix your necessary quantities of materials, begin by mixing small quantities of the phosphor into the monomer ensuring that the phosphor is thoroughly incorporated into the liquid. Continue adding small quantities of the phosphor until there is no "dry" phosphor left, and they are homogenously mixed together. The mixture will be a bit tacky due to the amount of solids presented into the monomer and usually takes between 3-5 minutes to become adequately mixed together by hand.

Step 4: Once the monomer/phosphor is homogenously mixed, add the catalyst to the mix. Ensure that all the catalyst is incorporated into the monomer/phosphor mixture. Continue mixing these 3 components together until all are homogenously mixed together. This step typically take 1-3 minutes to adequately mix. Note that in this step, once the catalyst begins mixing with the monomer/phosphor, the work and cure time for the epoxy will begin. Hardman® Green has a work time of approximately 1 hour, but typically begins losing its adhesion strength when mixed for this application in about 45 minutes.

Step 5: The next step is the hand application to put the mixture onto the back of the round taking care not to have spillover of material to the sides of the jacket and around the boattail. The material should cover only the base of the projectile and not exceed the edge of the round. Because this is hand applied, 2 methods were developed for use during application: dome method, and flat method. The domed method consists of placing the material on the back end of the projectile and allowing the material to self settle into a dome on the back of the round. The flat method requires less material and the applicant must create as thin a layer as possible completely covering the rear of the projectile, but not allowing an overexcess of material to allow the mixture to settle into a dome.

Figure 3:
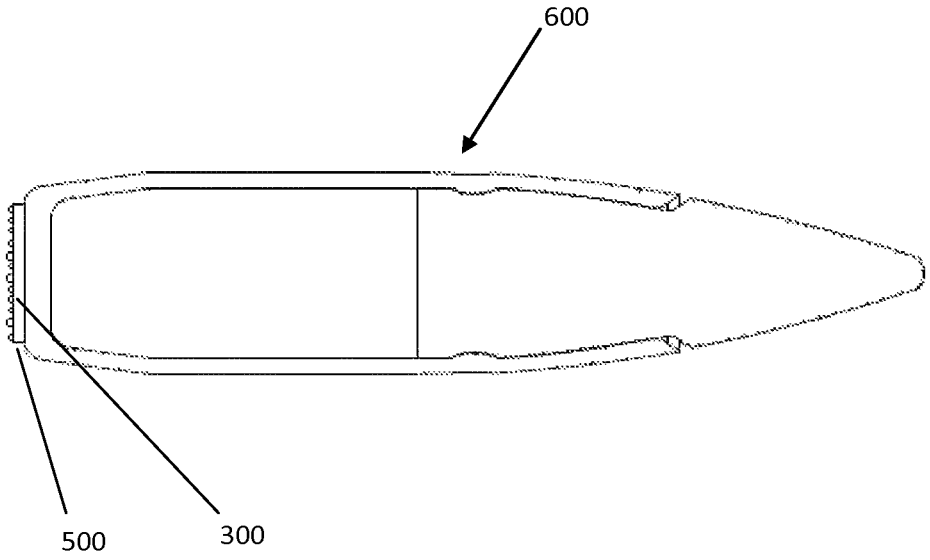
FIG. 3 is cross-sectional view of an embodiment of the current invention, wherein there is a layer of retro-reflective glass bead embedded along the rear side of the layer of phosphor photoluminescent tracer material located along the flat rear end of a typical projectile.

Step 6: The penultimate step is the application of the retro-reflectors to the epoxy/phosphor mix—which must be done while that mix is still tacky, i.e. prior to the curing of the expoxy. The retro-reflectors can be applied by dipping the rear of the projectile into a supply of the retro-reflectors—such that they adhere to the thin layer of phorphor material or more preferably sprinkled onto the base/rear of the projectile on top of the phosphor/expoxy mix—where the retro-reflectors will stick and settle in a desired depth, as the expoxy cures. See, FIG. 3, of a projectile of the present invention, 600, wherein a sprinkling of retro-reflectors, 500, is affixed to a thin layer of the photoluminescent material, 300. For example, on 5.56 mm projectiles, about 30 to 60 retro-reflectors may preferably be applied; and on 7.62 mm projectiles, about 100 to 150 retro-reflectors may preferably be applied. On larger .50 caliber projectiles, the quantity of these small retro-reflectors can be from about 300 to about 600.

Step 7: The final step is to place the projectiles vertically in a holder, point down and to allow the mixture to cure. The standard cure time of the preferred Hardman® Green, once applied to the back of the round is 24 hours. Note, depending on the type of epoxy used and the solids loading of the phosphor, work and cure times will be different.

Although the invention has been described in-part above in relation to embodiments thereof, it will be understood by those skilled in the art that variations and modifications can be effected in these preferred embodiments without departing from the scope and spirit of the invention as claimed below.

What is claimed is:

1. A method of manufacturing a low observable photoluminescent tracer projectile, for use with a small caliber weapon, comprising:

a. selecting a at least one photoluminescent phosphor material from the group consisting of
   0 to 50 wt. % Ca, and 0 to 50 wt. % Sr; and at least 50 wt. % S, with of at least one minor dopant ingredients selected from the group consisting of Eu, Sm, Dy, Ce, Mn, Cu, Al, and Tm;

b. compounding the selected phosphor material with 40 to 70 weight percent of a clear hinder to form a photoluminescent mixture;

c. applying a thin layer of said photoluminescent mixture to the flat rear end of a small arms projectile;

d. applying a plurality of retro-reflectors to the surface of the thin layer of said photoluminescent mixture.

2. The method of claim 1, wherein, in combination with the photoluminescent phosphor material, the selectable minor dopant ingredients are 0.01-1 wt. percent Eu, 0.01-1 wt. percent Sm, 0-1 wt. percent Dy, 0.01-1 wt. percent Ce, 0-1 wt. percent Mn, 0-1 wt. percent Cu, 0.01-1 wt. percent Al, and 0.01-1 wt. percent Tm.

3. The method of claim 1, where said clear binder is a 2-part epoxy.

4. The method of claim 1, wherein said retro-reflectors are selected from the group consisting of glass beads, cat's eyes, and corner cube retro-reflectors.

5. The method of claim 1, wherein said thin layer of said photoluminescent mixture is selected from the group consisting of a domed shaped and flat shaped configuration.

6. The method of claim 1, wherein the reacting propellant is selected from the group consisting of SMP-842, WC-844, WC-846, WC-860, HPC-33 and WPR-289.

7. The method of claim 1, wherein the photoluminescent phosphor material is a combination of Ca/Sr/S and wherein the photoluminescence persists for a luminescence time from 2 to 3 seconds.

8. The method of claim 1, wherein the reacting propellant primarily emit energy in the range of from 600 to 2,000 nm.

9. A method of manufacturing a low observable photoluminescent tracer projectile, for use with a small caliber weapon, comprising:

a. mixing 20 wt. % to 49 wt. % $Y_2$, 25 wt. % $O_2$, and 25 wt. % S, with at least one minor dopant selected from the group consisting of Yb, Er, Ho and Tm;

b. compounding the selected phosphor material with 40 to 70 wt. % of a clear binder to form a photoluminescent mixture;

c. applying a thin layer of said photoluminescent mixture to the flat rear end of a small arms projectile;

d. applying a plurality of retro-reflectors to the surface of the thin layer of said photoluminescent mixture.

10. The method of claim 9, wherein, the minor dopant are 1-20 wt. percent Yb, 0-6 wt. percent Er, 0-6 wt. percent Ho, and 0.01-6 wt. percent Tm.

* * * * *